United States Patent [19]

Weil et al.

[11] Patent Number: 4,906,251

[45] Date of Patent: Mar. 6, 1990

[54] GASOLINE ADDITIVE

[75] Inventors: Otto A. Weil, Chicago; Gerald G. Smith, Orland Park, both of Ill.

[73] Assignee: Gold Eagle Co., Chicago, Ill.

[21] Appl. No.: 270,967

[22] Filed: Nov. 14, 1988

[51] Int. Cl.[4] ..... C10L 1/18

[52] U.S. Cl. ..... 44/55; 44/62; 44/66; 44/70

[58] Field of Search ..... 44/55, 62, 66, 70

[56] References Cited

U.S. PATENT DOCUMENTS

| | | | |
|---|---|---|---|
| 3,880,752 | 4/1975 | Premo | 208/188 |
| 4,035,514 | 7/1977 | Davis | 252/52 A |
| 4,414,123 | 11/1983 | Zoleski et al. | 252/52 A |
| 4,609,376 | 9/1986 | Craig et al. | 44/70 |
| 4,612,255 | 9/1986 | Hein | 106/18.29 |

*Primary Examiner*—William R. Dixon, Jr.
*Assistant Examiner*—Ellen M. McAvoy
*Attorney, Agent, or Firm*—Gerstman & Ellis, Ltd.

[57] ABSTRACT

An additive for gasoline comprises a polyoxyethylene sorbitol polyoleate. It may be provided to the gasoline, which is typically gasohol, as a dispersion in a gasoline - miscible solvent to typically provide an additive concentration in the gasoline of 100 to 1000 p.p.m. The additive acts to prevent formation of a separate alcohol-water phase in the gasoline by making the phase more readily dispersable in the gasoline.

10 Claims, No Drawings

GASOLINE ADDITIVE

BACKGROUND OF THE INVENTION

This present invention relates to an additive for gasoline which, among other advantages, protects the Gasoline in which it is placed from negative effects of the presence of alcohols, methyl-t-butyl ether, or other oxygenated solvents in the gasoline.

A large amount of "gasohol" has been sold as motor fuel, the material being a mixture of gasoline and up to about 10 volume percent of alcohol and/or other oxygenated solvents. While there was initially an expectation that such was the fuel of the future, in fact certain disadvantages of gasohol have been noted. These disadvantages are so significant that the term "gasohol" is rarely used any more in presenting the product to the One major problem of gasohol is that, while the mixture is capable of absorbing and dispersing increased amounts of water when compared with pure gasoline, if too much water is present the water will separate out, and take a substantial amount of the alcohol component with it (or other oxygenated solvent). Such an alcohol-water mixture can accelerate rust and corrosion processes. Also, the separated alcohol-water mixture can damage plastic parts into which it comes in contact, and deterioration of the gasoline can be accelerated.

Additionally, especially in the case of two cycle engines, the presence of a second separate alcoholwater phase in the motor fuel creates a threat of actual motor damage, since two cycle engines rely on the presence of dissolved oil in the fuel for their lubrication. Naturally, an alcohol-water mixture is virtually devoid of oil, with the result that operation of two cycle engines with a fuel having a substantial alcohol-water separate phase present may cause engine damage due to lubrication failure.

Particularly where boat engines are concerned, there is a potentially serious problem with the use of gasohol, especially in two cycle engines. Because of the greatly increased potential for the entry of water into fuel for boats, it is common for a water-alcohol component to settle out and corrode gas tanks, valves, and carburetor components. The U.S. Coast Guard has actually issued a warning to boat owners concerning the potential hazards of gasohol.

Fuels containing alcohol also have the ability to absorb moisture from the air. Boats often sit idle long enough for phase separation to take place, so that the disadvantages of the use of gasohol in marine engines as well as other engines can be very significant.

For example, not only are plastic and rubber parts subject to rapid deterioration because of the created alcohol-water phase in the fuel, but the lead-tin alloy used to line fuel tanks can be corroded. Also carburetor floats can be damaged, and seals can be corroded. Likewise, the presence of this undesired alcohol-water phase can increase carbon deposits in the engine, pit carburetor metal parts, and form deposits that stop up oxygen sensors.

Similarly, because of the water-absorbing nature of alcohol, all engines may exhibit problems with gasohol if they stand idle in a high humidity environment for more than a few days.

In accordance with this invention, an additive for gasoline is provided that counteracts the negative effects of gasohol in a way that is superior to other gasoline additives of the prior art. Specifically, the additive of this invention inhibits the formation of a separate alcohol-gasoline phase by making the phase more readily dispersable in the gasoline, typically gasohol. When the alcohol of the gasohol, and the water carried therewith, is in a dispersed condition, the effect is to significantly reduce the known disadvantages which result from the use of gasoline mixed with oxygenated solvents.

DESCRIPTION OF THIS INVENTION

In accordance with this invention an additive for gasoline comprises a stable dispersion of three to twenty volume percent of a compound consisting essentially of a polyoxyethylene sorbitol polyoleate in a gasoline-miscible solvent. The gasoline-miscible solvent may substantially be an alcohol, and may be a mixture of solvents, typically with one or more oxygenated solvents predominating. However, hydrocarbon solvents may also be included, with the end result being a solvent system which is miscible with the gasoline to which it is added, and which is capable of providing a stable microdispersion of the active polyoleate ingredient as described above, to facilitate dispersion of the additive of this invention in gasoline.

Typically, the additive is intended for use with gasohol, but it may be used in pure gasolines, for example for the purpose of scavenging water from the bottom of the tank, or for insurance purposes when the user is uncertain as to whether or not the material is gasohol or not.

Preferably, the polyoleate compound of this invention is for the most part selected from the group consisting of polyoxyethylene sorbitol hexaoleates (six oleate units) and septaoleates (seven oleate units), and mixtures thereof. However, higher and lower homologs may also be used in varying quantities as may be desired and as may be appropriate for the particular circumstances of use. The polyoleate materials of this invention are known and commercially available, being made as described, for example, in Davis U.S. Pat. No. 4,035,514, which discloses alkoxylated sorbitol oleic acid esters such as 40 dendro sorbitol septaoleate, and the process of manufacturing the composition under conventional conditions by reacting sorbitol containing 15 weight percent water with 7 molar equivalents of oleic acid, and thereafter reacting the resulting product with 40 molar equivalents of ethylene oxide. Alternatively, 40 dendro sorbitol hexaoleate may be manufactured by reacting under similarly conventional conditions by reacting sorbitol containing 15 weight percent water with 6 moles of oleic acid, and thereafter reacting the product with 40 moles of ethylene oxide.

If desired, the molecular weight of the oleate product may be adjusted by using either greater or less amounts of ethylene oxide to provide either longer or shorter polyoxyethylene chains, to adjust and vary the miscibility and dispersion properties of the product of this invention as may be desired. Similarly, the use of different molar equivalents of acid may be used to create, for example a tetraoleate, a pentaoleate, or the like for similar alteration of the miscibility characteristics thereof and change of its surfactant properties, as may be desired.

The gasoline additive of this invention may also contain an effective amount of one or more corrosion inhibitors to suppress the corroding effect of the water phase dispersed in the gasoline by the additive of this invention. Similarly, the gasoline additive of this invention may contain an effective amount of fuel stabilizer to suppress the polymerization and other degradation of the gasoline present. Corrosion inhibitors and fuel stabilizers are well known additives for gasoline.

Likewise, the gasoline additive of this invention may contain a conventional fuel detergent to prevent clogging of the system for delivering fuel to the cylinders and the like.

Specifically, it is preferred for about 4 to 12 volume percent of the polyoleate compound of this invention to be present in the additive of this invention. The additive is than admixed, in use, with at least 20 times and typically up to about 100 times or more of its volume with gasoline, typically a gasohol formulation containing about 8 to 10 volume percent of oxygenated solvents.

In use, typically a gasohol fuel may comprise from 6 to 12 volume percent of methanol or ethanol (or another equivalent oxygenated solvent). In accordance with this invention, the fuel contains from 100 to 1000 parts per million (p.p.m. by volume), and preferably 200 to 500 p.p.m., of a dispersed compound consisting of essentially of the polyoxyethylene sorbitol polyoleate used in this invention, the balance of the fuel being substantially gasoline, Other, conventional fuel additives may also be present as well in their usual minor quantities.

As a specific embodiment, a gasoline additive formulation in accordance with this invention may be as follows:

| | Volume Percent |
|---|---|
| Arlatone T (101)-polyoxyethylene sorbitol polyoleate (ICI Americas, Inc.) | 6. |
| DuPont AO-36 | 0.83 |
| DuPont DMD-2 | 0.38 |
| DuPont DMA-65-D | 1.23 |
| DuPont DOI-11 | 0.78 |
| Mineral Spirits | 10. |
| Isobutanol | 10. |
| Isopropyl alcohol-99 percent | 70.78 |

Arlatone T is a mixture of compounds in the family of polyoxyethylene sorbitol polyoleates. The particular product is offered for sale by ICI Americas Inc. of Wilmington, Del. as a surfactant for floating bath oils. The material is not believed to have been previously used in motor fuels.

DuPont AO-36 is an antioxidant, and DuPont DMD-2 is a metal deactivator, both of these materials being conventional fuel stabilizers.

DuPont DMA-65-D is a conventional fuel detergent, while DuPont DOI-11 is a conventional corrosion inhibitor.

The presence of mineral spirits and isobutanol, mixed with isopropyl alcohol, is to provide a solvent system that is somewhat more hydrophobic than pure isopropanol.

The resulting formulation forms a stable, relatively homogenous dispersion which may be added to gasoline, typically to provide a concentration of 100 to 1000 parts per million of the polyoleate ingredient in the gasoline, which is typically gasohol.

The polyoleate remains well dispersed in its solvent for easy, homogenous dispersion in the gasoline by simple addition of the material of the additive into the gas tank. Once added to the gasoline, it serves to inhibit the separation of alcohol from the gasoline, even in the presence of substantial amounts of water, but rather causes any water-alcohol phase to remain intimately dispersed throughout the gasoline, to reduce the disadvantages encountered by phase separation as described above.

Equivalent compounds to the polyoleate specifically described herein may be synthesized and used in this invention by reacting other fatty acids of typically 12 to 30 carbon atoms with sorbitol in a manner similar to that described above, and then reacting the resulting product with ethylene oxide or propylene oxide. Resulting compounds may be designed to be equivalent to the polyoxyethylene sorbitol oleates as used herein.

The above has been offered for illustrative purposes only, and is not intended to limit the scope of the invention of this application, which is as defined in the claims below.

What is claimed is:

1. A method for improving the quality and performance of an internal combustion engine, which method comprises the steps of:

(a) introducing gasoline into the fuel tank of the internal combustion engine; and (b) adding to the gasoline, in an amount effective to improve the performance of an internal combustion engine, a stable dispersion of 3 to 20 volume percent of a compound consisting essentially of polyoxyethylene sorbitol polyoleate in a gasoline-miscible oxygenated organic solvent; and (c) operating the engine.

2. A method as defined by claim 1, in which said compound is selected from the group consisting of polyoxyethylene sorbitol hexaoleates, heptaleates, and mixtures hereof.

3. A method as defined by claim 1, in which said compound also contains an effective amount of corrosion inhibiter.

4. A method as defined by claim 1, in which said compound also contains an effective amount of fuel stabilizer.

5. A method as defined in claim 1, in which said compound is added to the gasoline until from 200 to 500 parts per million of said compound is present.

6. A method for improving the quality and performance of an internal combustion engine, which method comprises the steps of:

(a) introducing gasoline into the fuel tank of the internal combustion engine; and (b) adding to the gasoline, in an amount effective to improve the performance of an internal combustion engine, a stable dispersion of an effective amount of a compound consisting essentially of polyoxyethylene sorbitol polyoleate in a gasoline-miscible oxygenated organic solvent to cause any water-alcohol phase to remain intimately dispersed throughout the gasoline; and (c) operating the engine.

7. A method as defined by claim 6, in which said compound is selected from the group consisting of polyoxyethylene sorbitol hexaoleates, heptaoleate, and mixtures thereof.

8. A method as defined by claim 6, in which said compound also contains an effective amount of corrosion inhibiter.

9. A method as defined by claim 6, in which said compound also contains an effective amount of fuel stabilizer.

10. A method as defined in claim 6, in which said compound is added to the gasoline until from 200 to 500 parts per million of said compound is present.

* * * * *